United States Patent [19]

Pase

[11] 4,194,740

[45] Mar. 25, 1980

[54] TWO MAN VOLLEYBALL

[76] Inventor: Michael G. Pase, 11902 Mulberry Ave., Cumberland, Md. 21502

[21] Appl. No.: 790,260

[22] Filed: Apr. 25, 1977

[51] Int. Cl.[2] ..... A63B 71/00

[52] U.S. Cl. ..... 273/411

[58] Field of Search ..... 273/95 R, 95 H, 96 R, 273/1 R, 29 R, 30, 85 D, 90

[56] References Cited

U.S. PATENT DOCUMENTS

| | | | |
|---|---|---|---|
| 3,342,491 | 9/1967 | Padovani | 273/96 R |
| 3,507,494 | 4/1970 | Finkel | 273/67 R |
| 3,574,350 | 4/1971 | May | 273/85 D |
| 3,977,675 | 8/1976 | Leuthy, Jr. | 273/85 D |
| 4,034,978 | 7/1977 | Becker | 273/30 |
| 4,047,717 | 9/1977 | DeAngelis | 273/96 R X |

*Primary Examiner*—William H. Grieb

[57] ABSTRACT

Two man volleyball is an action game played by two players who compete against each others dexterity not only in skill and ease of using their hands, but also in their ability to employ mental quickness.

2 Claims, 1 Drawing Figure

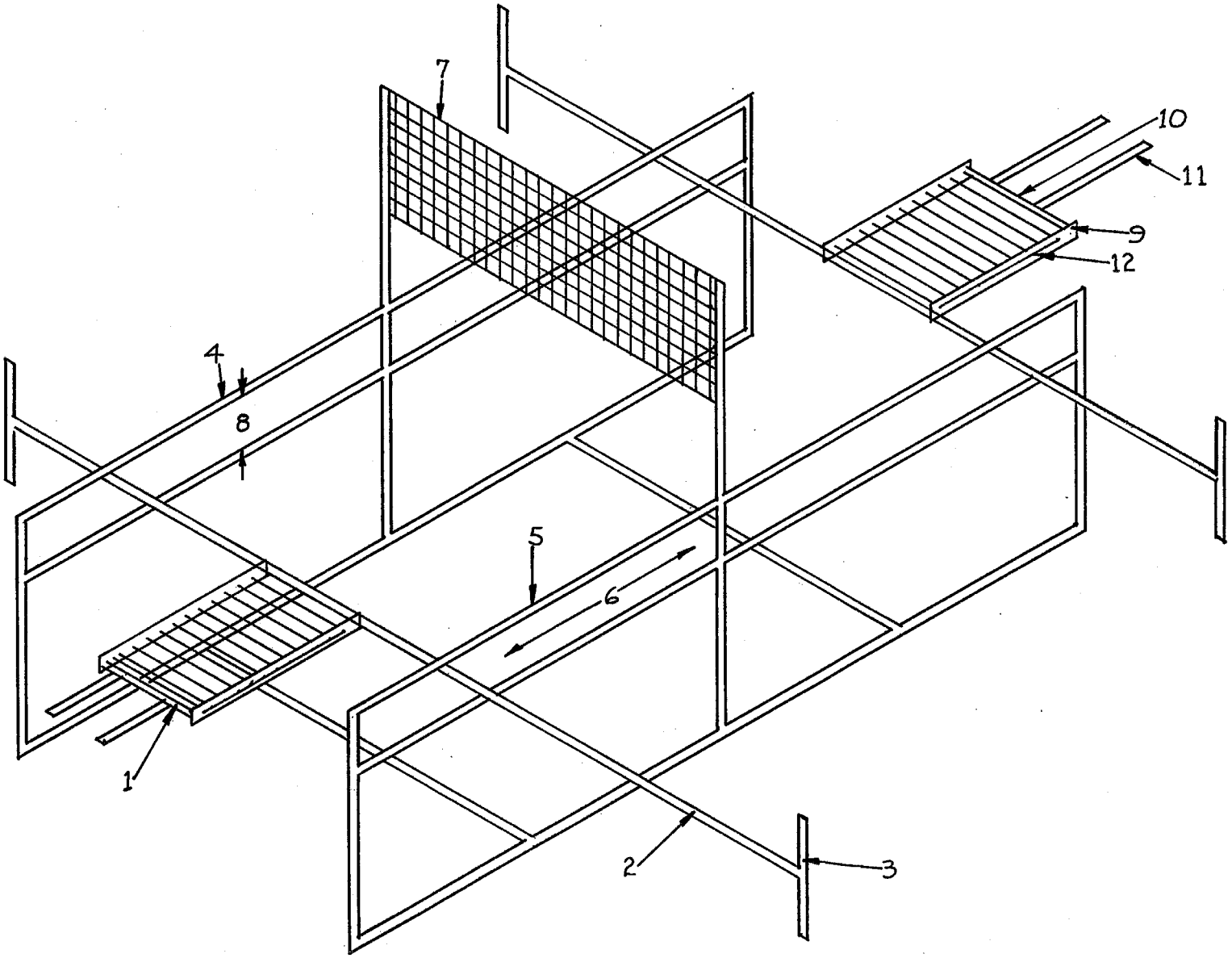
10
11
9
12
7
4
8
5
6
3
2
1

TWO MAN VOLLEYBALL

Two man Volleyball is played by two players who must employ strategy by hitting a small ball over a net and into the opponents side of the court. The game is of such scale that it can be played in a limited space, such as a room in a house. The ball is hit by a rectangular racket with its middle constructed of either a nylon, catgut or similar material which enables the player to give the ball considerable bounce. This rectangular racket is connected to a slide bar which enables the racket to slide back and forth on the frame of the game.

The FIGURE shows the game in its entirety including the rectangular rackets, and slide bars; the frame on which the rackets and slide bars rest, and the net which is placed in the middle of the frame.

Part 1 shows the nylon, catgut or similar fibers which enables the player to hit the ball with considerable bounce over the net which is part seven (7). Part 2 is the slide bar which the rectangular racket is connected to. At each end of the slide bar 2 there are stoppers 3 which prevent the slide bar from sliding out of the frame. This slide bar 2 must be of such length to enable the rectangular racket to cover the complete width of the frame as shown between parts 4 and 5. The frame is constructed so the slide bar is able to move freely back and forth as shown by arrow 6 and also up and down to enable various angles to be put on the racket as shown by arrow 8. The frame is constructed to achieve both maximum strength and maximum freedom of movement to the players by limiting the number of support bars, etc. Its construction also enables the game to be supported and played on a table top of much less area than the game itself. The game is also of such height that it can be played on the floor. The top of the net should be high enough to prevent any of the nylon or catgut material on the rectangular racket, when stood upright, from being as high. Part nine (9) is the sides of the rectangular rackets. The sides (9) are held together by support braces which are part 10. These support braces must be placed under the sides (part 9). Part 11 is the handles which the players hold to control the rectangular racket. Holes are drilled (part 12) in the sides (part 9) at a diameter to accommodate the material (part 1) which run from side to side (part 9) through the holes. This material which extends from side to side is given an appropriate tension that produces a maximum bounce. These holes should not be further apart than ⅛ of an inch, center to center. The frame of the game should not be any wider than 30 inches with a maximum length of 60 inches.

I claim:

1. A game apparatus comprising:

a frame having first and second longitudinal sides and first and second lateral ends;

a net mounted on said frame midway between said lateral ends and extending between said longitudinal sides;

first support means slidably mounted on said frame between said net and one of said ends for movement longitudinally, laterally and vertically with respect to said frame; and first racket means mounted on said first support means and adapted to be rotated between horizontal and vertical planes by a first player in attempting to hit a ball over said net to the other end of said frame.

2. The apparatus of claim 1 further comprising:

a second support means slidably mounted on said frame between said net and the other of said ends for movement longitudinally, laterally and vertically with respect to said frame; and second racket means mounted on said second support means and adapted to be rotated between horizontal and vertical planes by a second player in attempting to stop a ball hit by the first player and then return the ball over the net to the first player.

* * * * *